US012798914B2

(12) United States Patent
Masuda

(10) Patent No.: US 12,798,914 B2
(45) Date of Patent: Nov. 17, 2026

(54) SHEET CONVEYOR, STACKING MACHINE, AND PRINTING MACHINE

(71) Applicant: ALPHASYSTEM CORPORATION, Ibaraki (JP)

(72) Inventor: Daizo Masuda, Ibaraki (JP)

(73) Assignee: ALPHASYSTEM CORPORATION, Ibaraki (JP)

( * ) Notice: Subject to any disclaimer, the term of this patent is extended or adjusted under 35 U.S.C. 154(b) by 170 days.

(21) Appl. No.: 18/842,793

(22) PCT Filed: Sep. 27, 2023

(86) PCT No.: PCT/JP2023/035262
§ 371 (c)(1),
(2) Date: Aug. 29, 2024

(87) PCT Pub. No.: WO2025/069281
PCT Pub. Date: Apr. 3, 2025

(65) Prior Publication Data

US 2026/0159342 A1 Jun. 11, 2026

(51) Int. Cl.
*B65H 5/22* (2006.01)
*B65H 20/14* (2006.01)
(Continued)

(52) U.S. Cl.
CPC ..... *B65H 5/228* (2013.01); *B65H 20/14* (2013.01); *B65H 23/24* (2013.01); *B65H 23/32* (2013.01);
(Continued)

(58) Field of Classification Search
CPC .... B65H 5/228; B65H 20/14; B65H 2406/12; B65H 23/24; B65H 2406/111
See application file for complete search history.

(56) References Cited

U.S. PATENT DOCUMENTS 4,790,468 A * 12/1988 Nakashima ..... B65H 23/24 242/615.11
6,004,432 A * 12/1999 Page ..... B65H 23/32 162/271
(Continued)

FOREIGN PATENT DOCUMENTS

CN 1296264 C 1/2007
CN 100355019 C 12/2007
(Continued)

OTHER PUBLICATIONS

Office Action issued in Taiwanese Patent Application No. 112137531, dated Jul. 8, 2024.
(Continued)

*Primary Examiner* — Jeremy R Severson
(74) *Attorney, Agent, or Firm* — MARSHALL, GERSTEIN & BORUN LLP

(57) ABSTRACT

A sheet conveyor that conveys a sheet includes a first rotor, a second rotor, and a sheet levitating unit. The first rotor feeds the sheet. The second rotor rolls up the sheet. The sheet levitating unit is arranged between the first rotor and the second rotor in a transport path of the sheet and levitates the sheet. The sheet levitating unit includes a first discharge portion that faces the sheet and discharges gas toward the sheet. The first discharge portion is wider than the sheet.

11 Claims, 9 Drawing Sheets

(51) Int. Cl.
*B65H 23/24* (2006.01)
*B65H 23/32* (2006.01)
*B65H 29/24* (2006.01)

(52) U.S. Cl.
CPC ..... *B65H 29/24* (2013.01); *B65H 2301/4461* (2013.01); *B65H 2406/111* (2013.01); *B65H 2406/12* (2013.01); *B65H 2406/122* (2013.01); *B65H 2801/03* (2013.01)

(56) References Cited

U.S. PATENT DOCUMENTS 7,774,085 B2 * 8/2010 Yang ..... B65H 27/00 700/98
12,080,841 B2 * 9/2024 Inagaki ..... H01M 10/0585
2005/0098680 A1 * 5/2005 Naruoka ..... B65H 29/52 242/615.12
2006/0086259 A1 4/2006 Okajo

FOREIGN PATENT DOCUMENTS

| | | | |
|---|---|---|---|
| CN | 101596985 | A | 12/2009 |
| JP | 2007201380 | A | 8/2007 |
| JP | 2013040008 | A | 2/2013 |
| JP | 2021028966 | A | 2/2021 |
| TW | I734908 | B | 8/2021 |

OTHER PUBLICATIONS

International Search Report for PCT/JP2023/035262, mailed Dec. 12, 2023.

* cited by examiner

SHEET CONVEYOR, STACKING MACHINE, AND PRINTING MACHINE

TECHNICAL FIELD

The present disclosure relates to a sheet conveyor, a stacking machine, and a printing machine.

BACKGROUND ART

Patent Literature 1 describes an example of a roller device that discharges air from a rotation roller to levitate, for example, a semiconductor device tape when transporting the semiconductor device tape.

CITATION LIST

Patent Literature

Patent Literature 1: Japanese Laid-Open Patent Publication No. 2007-201380.

SUMMARY OF INVENTION

Technical Problem

In Patent Literature 1, the semiconductor device tape, or a sheet, is levitated off the roller by the discharged air. Thus, the sheet may move sideways or meander during transportation.

Solution to Problem (1) A sheet conveyor that solves the above problem conveys a sheet. The sheet conveyor includes a first rotor, a second rotor, and a sheet levitating unit. The first rotor feeds the sheet. The second rotor rolls up the sheet. The sheet levitating unit is arranged between the first rotor and the second rotor in a transport path of the sheet. The sheet levitating unit levitates the sheet. The sheet levitating unit includes a first discharge portion that faces the sheet and discharges gas toward the sheet. The first discharge portion is wider than the sheet.

With this structure, the first discharge portion is wider than the sheet. Thus, the gas discharged from the first discharge portion forms a wall of air at two sides of the sheet in the widthwise direction. In this manner, the sheet conveyor avoids a situation in which the sheet moves sideways or meanders during transportation of the sheet.

(2) In the sheet conveyor according to the above aspect (1), the sheet includes a first sheet surface, a second sheet surface, a first layer and a second layer. The second sheet surface is opposite to the first sheet surface. The first layer includes the first sheet surface and a conductive layer. The second layer includes the second sheet surface. The second layer is separable from the first layer. The sheet levitating unit is arranged in the transport path such that the first discharge portion faces the first sheet surface.

With this structure, the sheet levitating unit levitates the first sheet surface. This avoids a situation in which an object contacts the first layer and scratches the conductive layer.

(3) In the sheet conveyor according to the above aspect (1) or (2), the sheet levitating unit includes a gas storage portion that forms a reservoir. The reservoir temporarily stores gas supplied from a gas supplying unit. The first discharge portion is part of a storage wall that defines the gas storage portion. The first discharge portion includes through holes extending through the storage wall. The through holes are each formed by a first hole and a second hole. The first hole extends from an inner surface of the storage wall. The second hole extends from the first hole to an outer surface of the storage wall. The second hole is increased in diameter toward the outer surface.

With this structure, the sheet levitating unit levitates the sheet using the first hole and the second hole in a preferred manner.

(4) In the sheet conveyor according to the above aspect (3), the sheet levitating unit includes an internal-pressure adjuster that reduces a difference between an internal pressure proximate to a gas supply port and an internal pressure distant from the gas supply port in the gas storage portion.

With this structure, the sheet levitating unit uses the internal-pressure adjuster to reduce variations in the amount of air discharged from the through holes of the first discharge portion.

(5) In the sheet conveyor according to the above aspect (4), the internal-pressure adjuster includes an adjustment plate. The adjustment plate is configured to divide the reservoir in the gas storage portion into a first section and a second section. The first section includes the first discharge portion. The second section includes the gas supply port and does not include the first discharge portion. The adjustment plate includes connection holes that connect the first section and the second section.

With this structure, the sheet levitating unit uses the adjustment plate to reduce variations in the amount of air discharged from the through holes of the first discharge portion.

(6) In the sheet conveyor according to the above aspect (3), the first discharge portion of the sheet levitating unit includes a central region and a peripheral region located next to the central region. The central region includes a greater number of the through holes than the peripheral region.

With this structure, the sheet levitating unit levitates the sheet in a preferred manner.

(7) In the sheet conveyor according to any one of the above aspects (1) to (6), further includes a sheet separator arranged between the first rotor and the second rotor in the transport path of the sheet and separates the sheet. The sheet separator includes a suction portion that faces the sheet and suctions the sheet. The suction portion is narrower than the sheet.

With this structure, the suction portion is narrower than the sheet. Thus, the sheet separator suctions the sheet in a preferred manner.

(8) In the sheet conveyor according to the above aspect (7), the sheet separator includes a second discharge portion that faces the sheet and discharges gas toward the sheet.

With this structure, the sheet separator levitates the sheet with the second discharge portion in a preferred manner.

(9) A stacking machine that solves the above problem includes the sheet conveyor according to any one of the above aspects (1) to (8) and a pressing device.

With this structure, the stacking machine uses the sheet conveyor to avoid a situation in which the sheet moves sideways or meanders during transportation of the sheet. Thus, the stacking machine stacks workpieces in a preferred manner.

(10) A printing machine that solves the above problem includes the sheet conveyor according to any one of the above aspects (1) to (8) and a printing device.

With this structure, the printing machine uses the sheet conveyor to avoid a situation in which the sheet moves sideways or meanders during transportation of the sheet. Thus, the printing machine performs printing on the sheet in a preferred manner.

Advantageous Effects of Invention

The sheet conveyor, the stacking machine, and the printing machine according to the present disclosure avoid a situation in which the sheet moves sideways or meanders during transportation of the sheet.

DESCRIPTION OF EMBODIMENTS

A sheet conveyor 21, a stacking machine 1, and a printing machine 3 will now be described with reference to FIGS. 1 to 14.

First Embodiment

Stacking Machine

Figure 1:
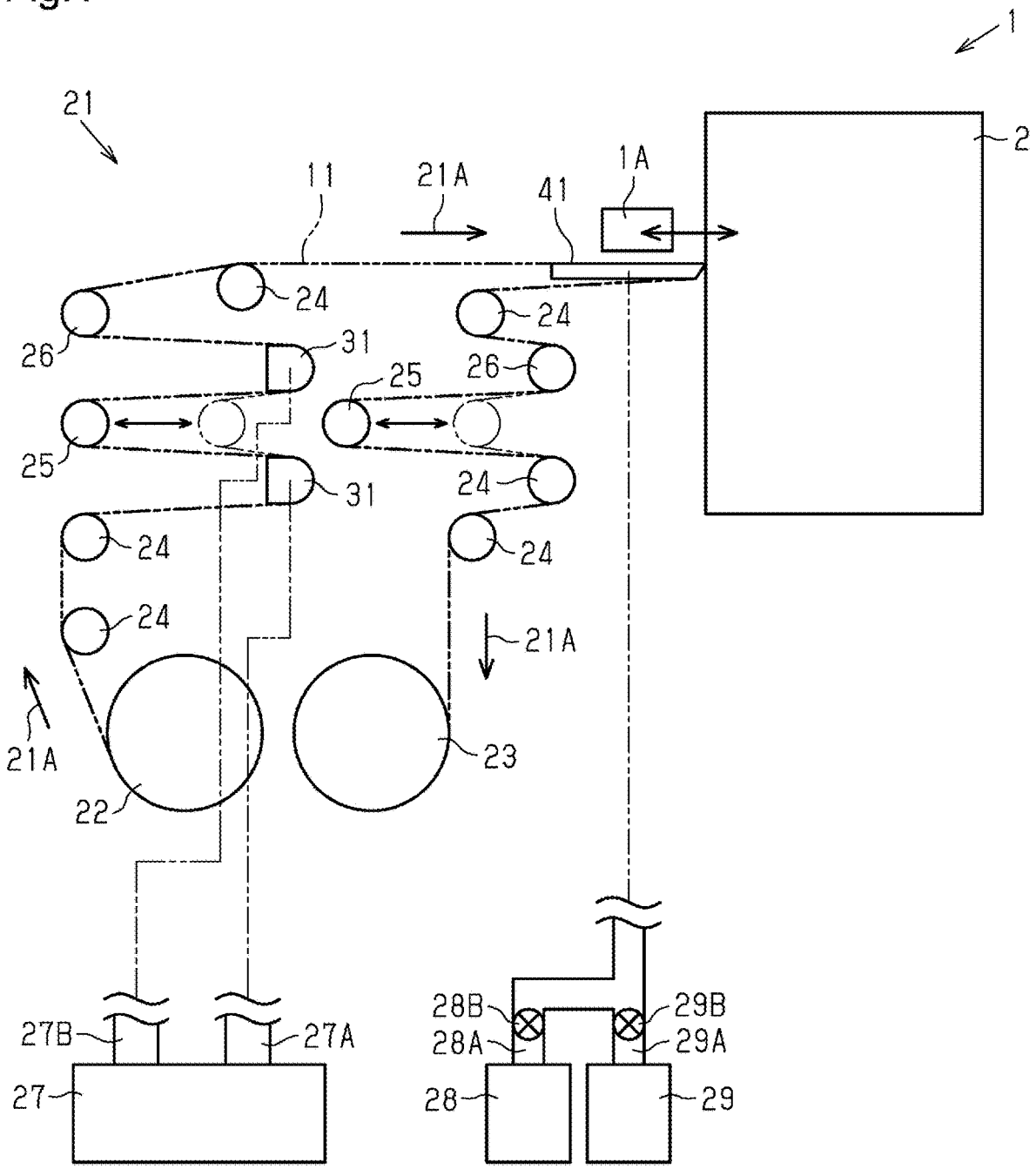
FIG. 1 is a schematic diagram of a stacking machine including a sheet conveyor and a pressing device in accordance with a first embodiment.

As shown in FIG. 1, the stacking machine 1 stacks workpieces. The stacking machine 1 includes a multi-layer ceramic capacitor (MLCC) stacking machine, a low temperature co-fired ceramics (LTCC) stacking machine, a lithium-ion stacking machine, a stacking machine for manufacturing a multilayer inductor, or a stacking machine for manufacturing a multilayer resistor.

The stacking machine 1 includes the sheet conveyor 21 and the pressing device 2. The pressing device 2 is configured to press a workpiece. The pressing device 2 presses workpieces to compression-bond the workpieces. Whenever a workpiece is conveyed into the pressing device 2, the pressing device 2 repeats compression-bonding of the workpiece to form a stack of workpieces.

Sheet

As shown in FIGS. 1 to 4, the sheet 11 includes workpieces. The sheet 11 is, for example, a ceramic green sheet. The sheet 11 may be a metal film or a resin film. Hereafter, the sheet 11 will be described as a ceramic green sheet.

The sheet 11 includes a first sheet surface 12, a second sheet surface 13 opposite to the first sheet surface 12, a first layer 14, and a second layer 15. The first layer 14 includes the first sheet surface 12 and a conductive layer 14A. The second layer 15 includes the second sheet surface 13 and is separable from the first layer 14. The second layer 15 is, for example, a carrier film.

The sheet 11 is set on the sheet conveyor 21 in a state in which the sheet 11 is rolled such that either one of the first sheet surface 12 or the second sheet surface 13 faces outward. For example, the sheet 11 is set on the sheet conveyor 21 in a state in which the sheet 11 is rolled such that the first sheet surface 12 faces outward.

Sheet Conveyor

The sheet conveyor 21 is configured to convey the sheet 11. The sheet conveyor 21 is used to manufacture, for example, various types of electronic components.

Figure 2:
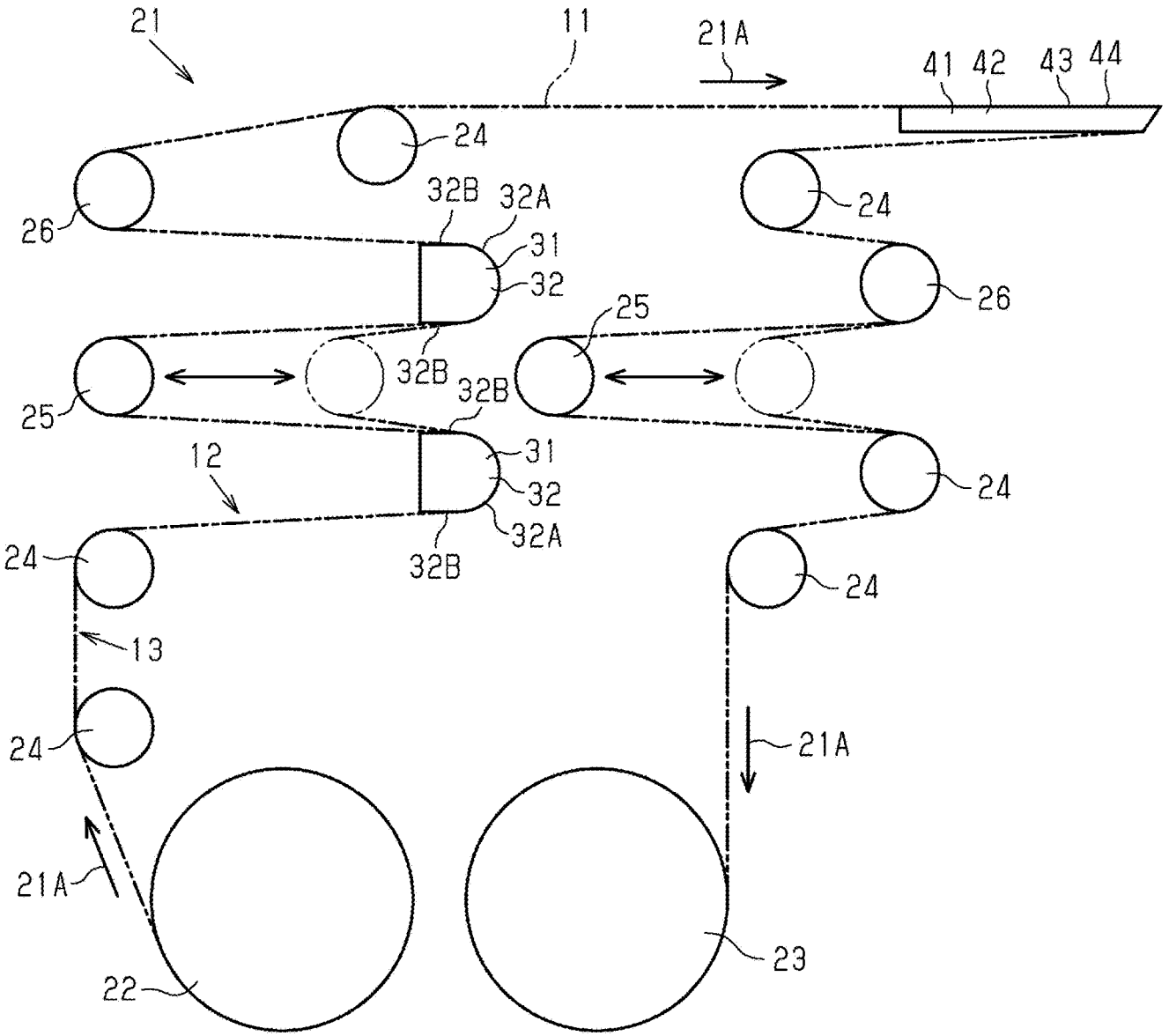
FIG. 2 is a schematic diagram of the sheet conveyor shown in FIG. 1.
Figure 3:
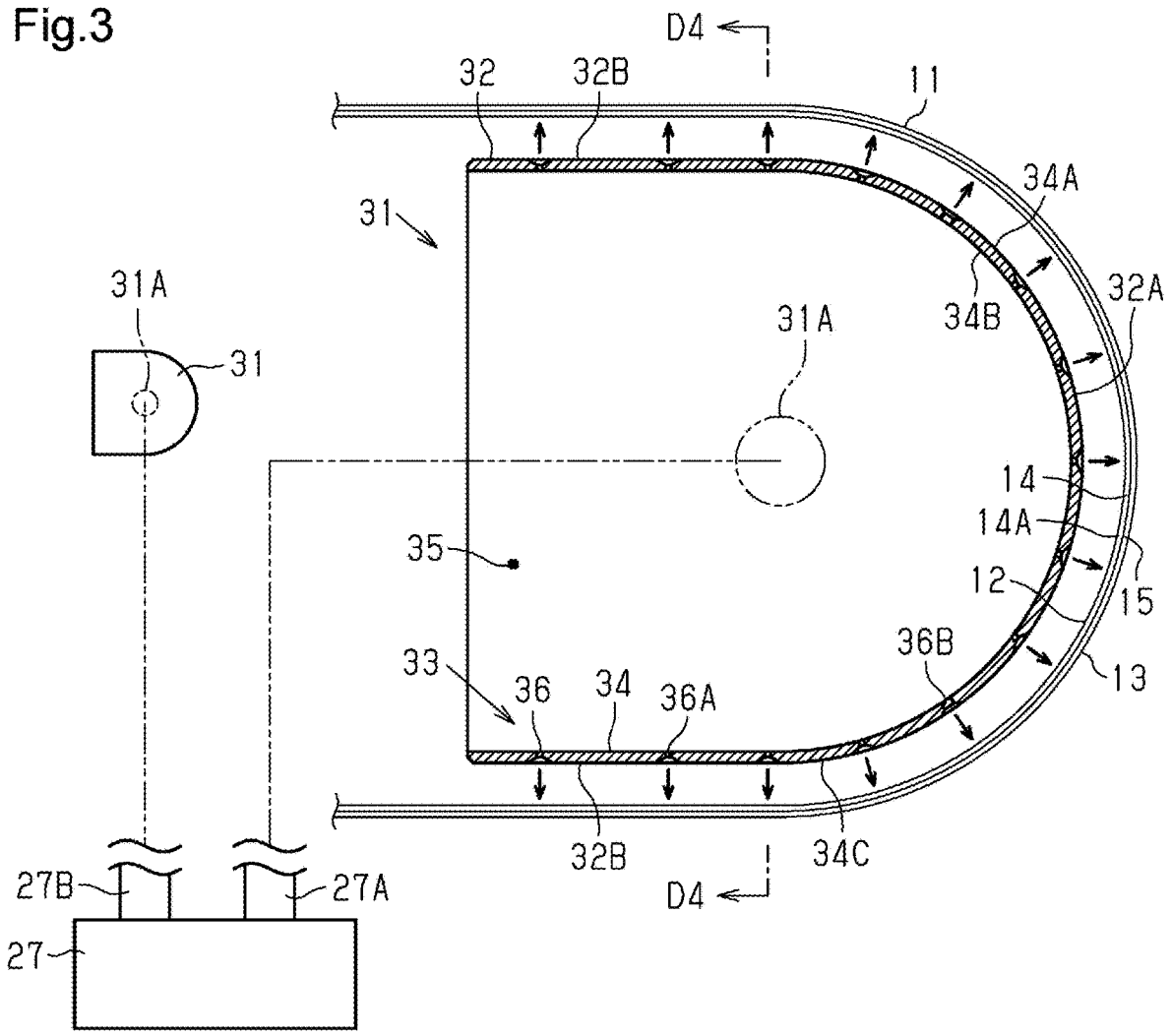
FIG. 3 is a schematic diagram showing a gas supply unit and a cross section of a sheet levitating unit shown in FIG. 1.

As shown in FIG. 2, the sheet conveyor 21 includes a first rotor 22, a second rotor 23, and a sheet levitating unit 31. The first rotor 22 feeds the sheet 11. The second rotor 23 rolls up the sheet 11. The sheet levitating unit 31 is arranged between the first rotor 22 and the second rotor 23 in a transport path 21A of the sheet 11 and levitates the sheet 11.

The sheet conveyor 21 includes at least one sheet levitating unit 31. The sheet conveyor 21 includes, for example, two sheet levitating units 31. The sheet levitating unit 31 faces the first sheet surface 12 of the sheet 11. There may be only one sheet levitating unit 31. When the sheet conveyor 21 includes only one sheet levitating unit 31, for example, a member that differs from the sheet levitating unit 31 and has a configuration for levitating the sheet 11 will be arranged at a position where another sheet levitating unit 31 would be arranged.

The sheet conveyor 21 includes a gas supply unit 27. The gas supply unit 27 supplies gas to the sheet levitating unit 31. An example of the gas is air. When the sheet conveyor 21 includes more than one sheet levitating unit 31, each sheet levitating unit 31 may be provided with a corresponding gas supply unit 27. Alternatively, a single gas supply unit 27 may be configured to supply gas to each sheet levitating unit 31. When a single gas supply unit 27 supplies gas to more than one sheet levitating unit 31, the gas supply unit 27 includes more than one port.

The first rotor 22 is rotated by a first actuator. The first actuator includes, for example, an electric motor. The electric motor of the first actuator is controlled by, for example, an inverter. The sheet 11 is set on the first rotor 22 in a state in which the sheet 11 is rolled such that the first sheet surface 12 faces outward. The first rotor 22 feeds the sheet 11 by the rotational force of the first actuator.

The second rotor 23 is rotated by a second actuator that differs from the first actuator. The second actuator includes, for example, an electric motor. The electric motor of the second actuator is controlled by, for example, an inverter. The second rotor 23 rolls up a sheet remaining portion 16 of the sheet 11 by the rotational force of the second actuator. The sheet remaining portion 16 is separated from the sheet 11 by a sheet separator 41.

The sheet conveyor 21 further includes the sheet separator 41. The sheet separator 41 is arranged between the first rotor 22 and the second rotor 23 in the transport path 21A and separates the sheet 11. The sheet separator 41 is, for example, a separation table. The sheet separator 41 faces the second sheet surface 13 of the sheet 11.

The sheet separator 41 suctions or levitates the sheet 11. The stacking machine 1 includes, for example, a suction-holding head 1A that has a cutter. The sheet separator 41 separates workpieces from the sheet 11 in cooperation with the suction-holding head 1A. In the present embodiment, the remaining part of the sheet 11 other than the workpieces will be referred to as the sheet remaining portion 16.

The suction-holding head 1A cuts part of the first layer 14 of the sheet 11, which serves as a workpiece, with the cutter and holds the workpiece by suction. Then, the sheet separator 41 is moved horizontally relative to the suction-holding head 1A in a state in which the second sheet surface 13 of the sheet 11 is suctioned to the sheet separator 41. This separates the sheet remaining portion 16 and the sheet 11 in a state in which the workpiece is held by the suction-holding head 1A. Subsequently, the suction-holding head 1A conveys the workpiece to the pressing device 2 and places the workpiece on a stack inside the pressing device 2. The sheet separator 41 returns from the position, to which the sheet separator 41 is moved relative to the suction-holding head 1A, to a position below the suction-holding head 1A in a state in which the sheet 11 is levitated by the sheet separator 41.

The sheet conveyor 21 includes a sheet-separator gas supply unit 28. The sheet-separator gas supply unit 28 supplies gas to the sheet separator 41. An example of the gas is air. The sheet conveyor 21 includes a gas suction unit 29. The gas suction unit 29 draws gas out of the sheet separator 41. The sheet-separator gas supply unit 28 and the gas suction unit 29 may be arranged on a single device or different devices.

The sheet conveyor 21 further includes guide rolls 24 arranged between the first rotor 22 and the second rotor 23 in the transport path 21A. The guide rolls 24 guide the sheet 11. For example, the guide rolls 24 are arranged at predetermined positions in the transport path 21A. The sheet conveyor 21 includes, for example, seven guide rolls 24. Each of the guide rolls 24 faces the second sheet surface 13 of the sheet 11.

The sheet conveyor 21 further includes dancer rolls 25. The dancer rolls 25 are moved in accordance with feeding of the sheet 11 and movement of the sheet 11. The dancer rolls 25 are arranged between the first rotor 22 and the second rotor 23 in the transport path 21A. The dancer rolls 25 reduce slack in the sheet 11 caused by a difference in the rotational speed between the first rotor 22 and the second rotor 23. For example, the dancer rolls 25 each include a support shaft configured to be movable in a vertical direction or a sideward direction. The sheet conveyor 21 includes, for example, two dancer rolls 25. The dancer rolls 25 face the second sheet surface 13 of the sheet 11.

The sheet conveyor 21 further includes at least one tension roll 26. The at least one tension roll 26 is arranged between the first rotor 22 and the second rotor 23 in the transport path 21A and adjusts the tension applied to the sheet 11. The sheet conveyor 21 includes, for example, two tension rolls 26. For example, the at least one tension roll 26 faces the second sheet surface 13 of the sheet 11. For example, the at least one tension roll 26 is arranged at a predetermined position in the transport path 21A. The at least one tension roll 26 may include a support shaft configured to be moved sideward so as to adjust the tension applied to the sheet 11.

The transport path 21A will now be described. When the first rotor 22 feeds the sheet 11, the sheet 11 is guided by the two guide rolls 24 and conveyed to the sheet levitating units 31. The first dancer roll 25 is arranged between the two sheet levitating units 31. The sheet 11 is conveyed from the first sheet levitating unit 31 to the first dancer roll 25 and then to the second sheet levitating unit 31. The sheet 11 is conveyed from the second sheet levitating unit 31 to the first tension roll 26. After the sheet 11 is conveyed to the first tension roll 26, the sheet 11 is guided by the guide roll 24 and conveyed to the sheet separator 41.

When the sheet 11 is conveyed to the sheet separator 41, the sheet 11 is held by the suction-holding head 1A. Then, the suction-holding head 1A cuts part of the sheet 11 as a workpiece. After the suction-holding head 1A conveys the workpiece to the pressing device 2, the workpiece is placed on a stack inside the pressing device 2. The sheet remaining portion 16, which is separated from the sheet 11, is guided by the guide roll 24 and conveyed to the second tension roll 26. After the sheet remaining portion 16 is conveyed to the second tension roll 26, the sheet remaining portion 16 is conveyed to the second dancer roll 25. The sheet remaining portion 16 of the sheet 11 is conveyed from the second dancer roll 25 to the two guide rolls 24. Subsequently, the second rotor 23 rolls up the sheet remaining portion 16.

Sheet Levitating Unit

The sheet levitating unit 31 will now be described in detail with reference to FIGS. 1 to 7. When the sheet conveyor 21 includes more than one sheet levitating unit 31, each sheet levitating unit 31 has the same configuration.

The sheet levitating unit 31 includes a sheet levitating unit body 32. At least part of the sheet levitating unit body 32 faces the sheet 11. At least part of the sheet levitating unit body 32 is U-shaped. The sheet levitating unit body 32 includes a curved part 32A and a flat part 32B on a portion where a first discharge portion 33 is arranged. The curved part 32A is curved along the transport path 21A.

The sheet levitating unit 31 includes the first discharge portion 33. The first discharge portion 33 faces the sheet 11 and discharges gas toward the sheet 11. The first discharge portion 33 is arranged on the sheet levitating unit body 32. The sheet levitating unit 31 is arranged in the transport path 21A such that the first discharge portion 33 faces the first sheet surface 12 of the sheet 11.

The gas supply unit 27 includes a first port 27A and a second port 27B. The sheet levitating unit 31 includes a gas supply port 31A. The first port 27A and the second port 27B are each connected to the gas supply ports 31A of a corresponding one of the sheet levitating units 31. The gas supply unit 27 supplies gas through the first port 27A to the first sheet levitating unit 31. The gas supply unit 27 supplies gas through the second port 27B to the second sheet levitating unit 31. When the sheet conveyor 21 includes only one sheet levitating unit 31, either the first port 27A or the second port 27B may be omitted.

The sheet levitating unit 31 includes a gas storage portion 34 that forms a reservoir 35. The reservoir 35 temporarily stores the gas supplied from the gas supply unit 27. The gas storage portion 34 is defined by a storage wall 34A. The storage wall 34A includes an inner surface 34B facing the reservoir 35 and an outer surface 34C facing the sheet 11.

The first discharge portion 33 is part of the storage wall 34A, which defines the gas storage portion 34. The first discharge portion 33 includes through holes 36 that extend through the storage wall 34A. The gas supplied from the gas supply unit 27 is discharged through the through holes 36 to the sheet 11.

The through holes 36 are each formed by a first hole 36A and a second hole 36B. The first hole 36A extends from the inner surface 34B of the storage wall 34A. The second hole 36B extends from the first hole 36A to the outer surface 34C of the storage wall 34A. The second hole 36B is increased in diameter toward the outer surface 34C. The gas supplied from the gas supply unit 27 is discharged from the first hole 36A at a predetermined pressure and spread out of the second hole 36B in a wide range.

Figure 4:
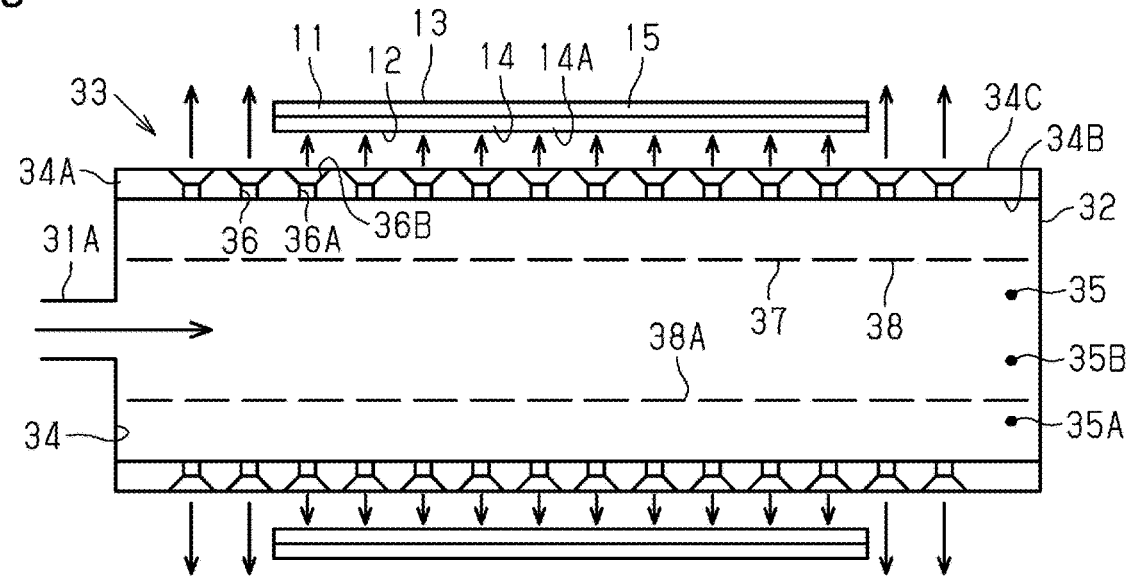
FIG. 4 is a schematic diagram of the sheet levitating unit showing a cross section taken along line D4-D4 in FIG. 3.

As shown in FIG. 4, the sheet levitating unit 31 includes an internal-pressure adjuster 37 that reduces a difference between an internal pressure proximate to the gas supply port 31A and an internal pressure distant from the gas supply port 31A in the gas storage portion 34. Hereafter, the internal pressure of the gas storage portion 34 proximate to the gas supply port 31A will be referred to as "the proximate internal pressure", and the internal pressure of the gas storage portion 34 distant from the gas supply port 31A will be referred to as "distant internal pressure".

The internal-pressure adjuster 37 includes an adjustment plate 38. The adjustment plate 38 is, for example, a metal plate. The adjustment plate 38 may be a resin plate. For example, the adjustment plate 38 is curved along the curved part 32A of the sheet levitating unit body 32. The adjustment plate 38 is configured to divide the reservoir 35 in the gas storage portion 34 into a first section 35A and a second section 35B. The first section 35A includes the first discharge portion 33. The second section 35B includes the gas supply port 31A and does not include the first discharge portion 33.

The adjustment plate 38 includes communication holes 38A that connect the first section 35A and the second section 35B. The gas from the gas supply unit 27 is supplied to the second section 35B, and then moved from the second section 35B through the communication holes 38A to the first section 35A.

When a large amount of gas is supplied, the proximate internal pressure becomes lower than the distant internal pressure due to the supply of gas from the gas supply unit 27. The gas is compressed near the end of the gas storage portion 34 that is distant from the gas supply port 31A. Thus, the distant internal pressure becomes higher than the proximate internal pressure. In contrast, when a small amount of gas is supplied, the proximate internal pressure becomes higher than the distant internal pressure due to the supply of gas from the gas supply unit 27. A portion of the gas storage portion 34 distant from the gas supply port 31A is separated from the gas supply port 31A. Thus, the distant internal pressure becomes lower than the proximate internal pressure. When the sheet levitating unit 31 includes the adjustment plate 38, the gas supplied from the gas supply unit 27 is retained in the second section 35B and then moved through the communication holes 38A of the adjustment plate 38 to the first section 35A. This reduces the difference between the proximate internal pressure and the distant internal pressure in the first section 35A.

Figure 5:
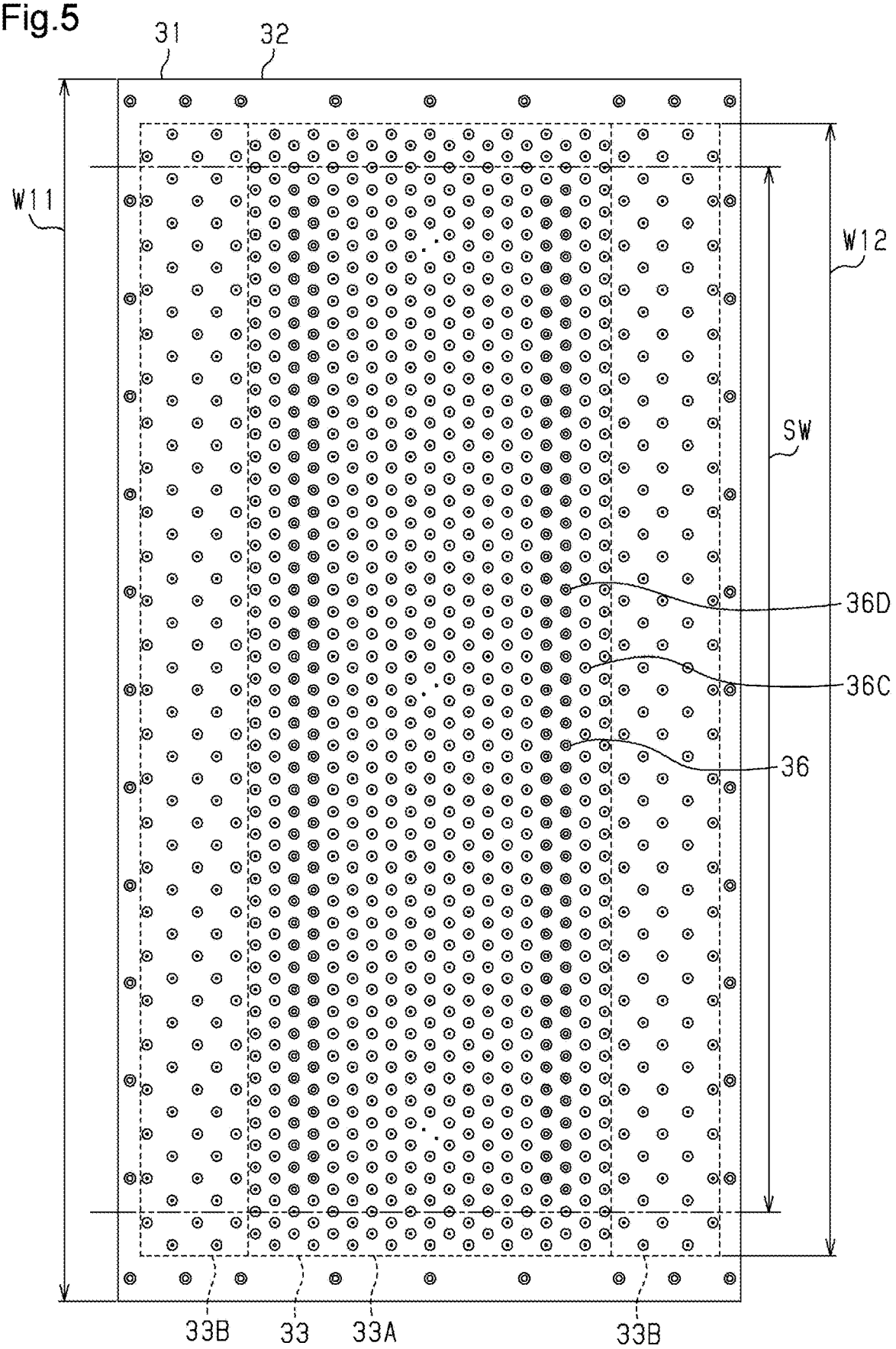
FIG. 5 is a developed view showing a first discharge portion of the sheet levitating unit shown in FIG. 1.

As shown in FIG. 5, the sheet levitating unit body 32 has a width W11. The first discharge portion 33 has a width W12. The sheet 11 has a width SW. The width W11, the width W12, and the width SW are measured in a direction orthogonal to the transport path 21A. The width W11 of the sheet levitating unit body 32 is greater than the width W12 of the first discharge portion 33. The width W12 of the first discharge portion 33 is greater than the width SW of the sheet 11.

FIG. 4 schematically shows the gas being discharged from the first discharge portion 33. Since the width W12 of the first discharge portion 33 is greater than the width SW of the sheet 11, the gas discharged from the first discharge portion 33 forms a gas wall at the two opposite sides of the sheet 11. This restricts sideward movement and meandering of the sheet 11.

The first discharge portion 33 of the sheet levitating unit 31 includes a central region 33A and a peripheral region 33B located next to the central region 33A. The central region 33A includes a greater number of through holes 36 than the peripheral region 33B. In other words, the through holes 36 in the central region 33A are denser than the through holes 36 in the peripheral region 33B. The central region 33A is located on the curved part 32A and part of the flat part 32B of the sheet levitating unit body 32. The peripheral region 33B is located on the flat part 32B of the sheet levitating unit body 32.

The flow rate of gas that levitates the sheet 11 differs between the curved part 32A and the flat part 32B. At the curved part 32A, a greater amount of tension is applied to the sheet 11 than at the flat part 32B. Thus, the flow rate of gas that levitates the sheet 11 is greater at the curved part 32A than at the flat part 32B. The central region 33A extends substantially from a part where the curve starts to a part where the curve ends. Thus, the sheet levitating unit 31 appropriately levitates the sheet 11.

Figure 6:
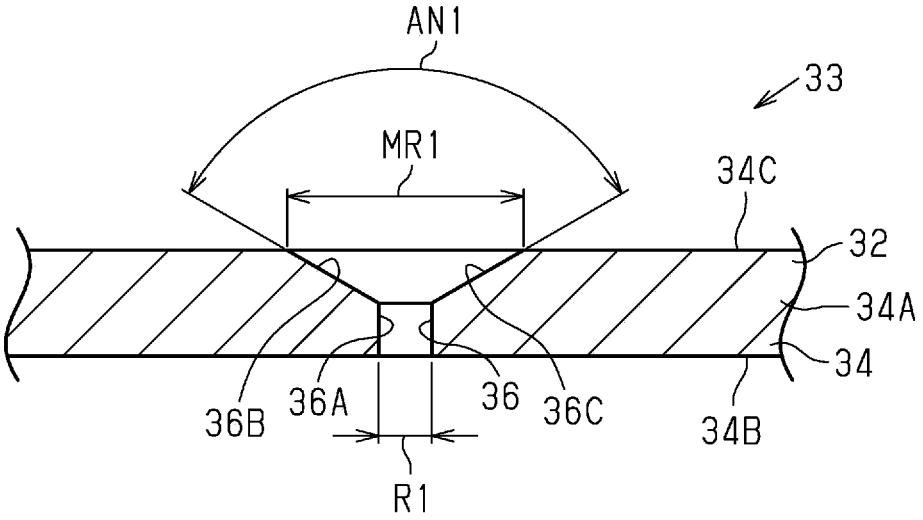
FIG. 6 is an enlarged view of one of first through holes shown in FIG. 5.
Figure 7:
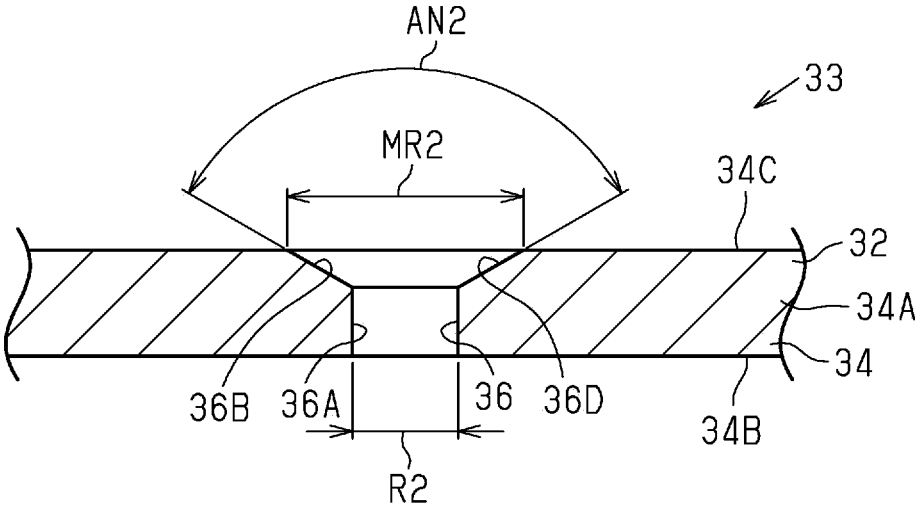
FIG. 7 is an enlarged view of one of second through holes shown in FIG. 5.

As shown in FIGS. 6 and 7, the through holes 36 include first through holes 36C and second through holes 36D. The first hole 36A of each first through hole 36C has a diameter R1 that is less than a diameter R2 of the first hole 36A of each second through hole 36D. The second hole 36B of the first through hole 36C has a maximum diameter MR1 that is substantially equal to a maximum diameter MR2 of the second hole 36B of the second through hole 36D. The maximum diameter MR1 may differ from the maximum diameter MR2. The walls of the second hole 36B of the first through hole 36C form an angle AN1 that is substantially equal to an angle AN2 formed by the walls of the second hole 36B of the second through hole 36D. The angle AN1 may differ from the angle AN2.

The first through holes 36C are arranged in both the central region 33A and the peripheral region 33B. The second through holes 36D are arranged in the central region 33A. Since the diameter R2 of the first hole 36A of the second through hole 36D is greater than the diameter R1 of the first hole 36A of the first through hole 36C, the second through hole 36D can discharge a greater flow rate of gas than the first through hole 36C. Thus, for example, the second through holes 36D are selectively arranged in portions of the central region 33A where a flow rate of gas is used to levitate the sheet 11.

Sheet Separator

Figure 8:
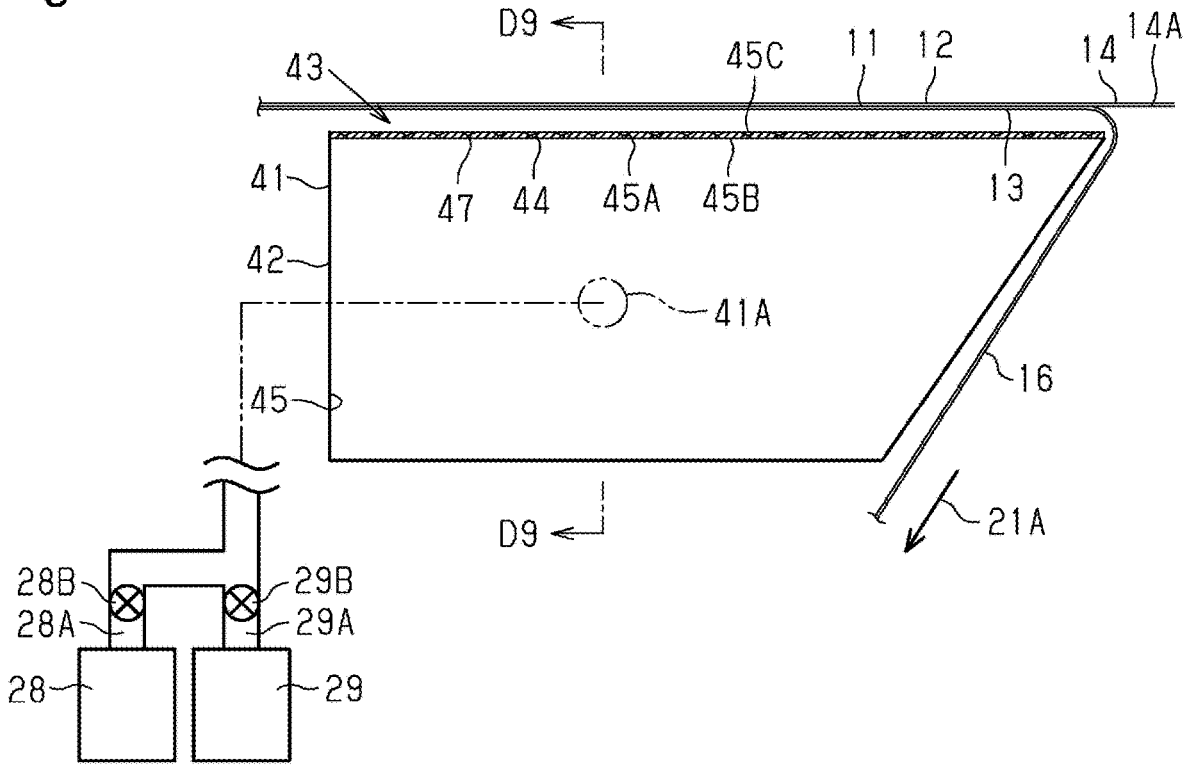
FIG. 8 is a schematic diagram showing a cross section of a sheet separator shown in FIG. 1.

The sheet separator 41 will now be described in detail with reference to FIGS. 1, 8, and 9. The sheet separator 41 includes a sheet separator body 42. The sheet separator body 42 is arranged on the sheet conveyor 21 such that the sheet separator body 42 is parallel to the pressing device 2. The sheet separator 41 includes a gas supply-suction port 41A through which gas is supplied or drawn out.

The sheet separator 41 includes a suction portion 43 that faces the sheet 11 and suctions the sheet 11. The suction portion 43 is arranged on a part of the sheet separator body 42 that faces the sheet 11. The sheet separator 41 is arranged in the transport path 21A such that the suction portion 43 faces the second sheet surface 13 of the sheet 11.

The sheet separator 41 includes a second discharge portion 44 that faces the sheet 11 and discharges gas toward the sheet 11. The second discharge portion 44 is arranged on a part of the sheet separator body 42 that faces the sheet 11. The sheet separator 41 is arranged in the transport path 21A such that the second discharge portion 44 faces the second sheet surface 13 of the sheet 11. The suction portion 43 is arranged on the sheet separator body 42 in correspondence with the second discharge portion 44.

The sheet-separator gas supply unit 28 includes a third port 28A. The third port 28A is connected to the gas supply-suction port 41A of the sheet separator 41. The sheet-separator gas supply unit 28 supplies gas through the third port 28A to the sheet separator 41.

The gas suction unit 29 includes a fourth port 29A. The fourth port 29A is connected to the gas supply-suction port 41A of the sheet separator 41. The gas suction unit 29 draws gas out of the sheet separator 41 through the fourth port 29A.

The sheet-separator gas supply unit 28 includes a first switching valve 28B. The gas suction unit 29 includes a second switching valve 29B. The third port 28A and the fourth port 29A are both connected to the gas supply-suction port 41A of the sheet separator 41. The sheet separator 41 switches open and closed states of the first switching valve 28B and the second switching valve 29B so that gas is supplied to and drawn out of the sheet separator 41. When the sheet-separator gas supply unit 28 supplies gas to the sheet separator 41, the sheet separator 41 opens the first switching valve 28B and closes the second switching valve 29B. When the gas suction unit 29 draws gas out of the sheet separator 41, the sheet separator 41 closes the first switching valve 28B and opens the second switching valve 29B.

The sheet separator 41 includes a first gas storage portion 45 that forms a first reservoir 46. The first reservoir 46 temporarily stores the gas supplied from the sheet-separator gas supply unit 28. The first gas storage portion 45 is defined by a first storage wall 45A.

The suction portion 43 and the second discharge portion 44 are part of the first storage wall 45A, which defines the first gas storage portion 45. The suction portion 43 and the second discharge portion 44 include sheet-separator through holes 47 that extend through the first storage wall 45A. The gas supplied from the sheet-separator gas supply unit 28 is discharged toward the sheet 11 through the sheet-separator through holes 47. Further, the gas suction unit 29 draws gas through the sheet-separator through holes 47. The sheet-separator through holes 47 are each formed by, for example, a third hole 47A and a fourth hole 47B. The third hole 47A extends from a first inner surface 45B of the first storage wall 45A. The fourth hole 47B extends from the third hole 47A to a first outer surface 45C of the first storage wall 45A. The fourth hole 47B is increased in diameter toward the first outer surface 45C.

Figure 9:
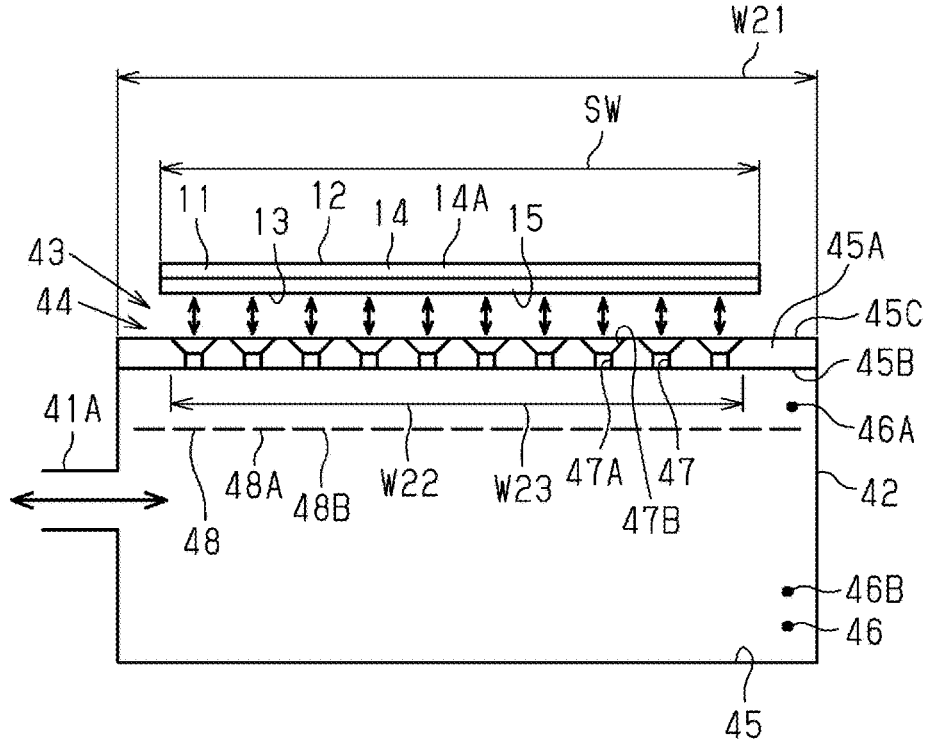
FIG. 9 is a schematic diagram of the sheet separator showing a cross section taken along line D9-D9 in FIG. 8.

As shown in FIG. 9, the sheet separator 41 includes a first internal-pressure adjuster 48. When the sheet-separator gas supply unit 28 supplies gas to the sheet separator 41, the first internal-pressure adjuster 48 reduces a difference between an internal pressure proximate to the gas supply-suction port 41A and an internal pressure distant from the gas supply-suction port 41A in the first gas storage portion 45.

The first internal-pressure adjuster 48 includes a sheet-separator adjustment plate 48A. The sheet-separator adjustment plate 48A is, for example, a metal plate. The sheet-separator adjustment plate 48A may be a resin plate. The sheet-separator adjustment plate 48A is configured to divide the first reservoir 46 in the first gas storage portion 45 into a third section 46A and a fourth section 46B. The third section 46A includes the suction portion 43 and the second discharge portion 44. The fourth section 46B includes the gas supply-suction port 41A and does not include the suction portion 43 or the second discharge portion 44. The sheet-separator adjustment plate 48A includes holes 48B that connect the third section 46A and the fourth section 46B.

As shown in FIG. 9, the sheet separator body 42 has a width W21. The suction portion 43 has a width W22. The second discharge portion 44 has a width W23. The widths W21, W22, and W23 are measured in a direction orthogonal to the transport path 21A. The width W21 of the sheet separator body 42 is greater than the width W22 of the suction portion 43. The width W21 of the sheet separator body 42 is greater than the width W23 of the second discharge portion 44. The width W22 of the suction portion 43 is less than the width SW of the sheet 11. The width W23 of the second discharge portion 44 is less than the width SW of the sheet 11.

Advantages of the First Embodiment

The first embodiment has the following advantages.

(1-1) The sheet conveyor 21 conveys the sheet 11. The sheet conveyor 21 includes the first rotor 22, the second rotor 23, and the sheet levitating unit 31. The first rotor 22 feeds the sheet 11. The second rotor 23 rolls up the sheet 11. The sheet levitating unit 31 is arranged between the first rotor 22 and the second rotor 23 in the transport path 21A of the sheet 11. The sheet levitating unit 31 levitates the sheet 11. The sheet levitating unit 31 includes the first discharge portion 33. The first discharge portion 33 faces the sheet 11 and discharges gas toward the sheet 11. The width W12 of the first discharge portion 33 is greater than the width SW of the sheet 11.

With this structure, the width W12 of the first discharge portion 33 is greater than the width SW of the sheet 11. Thus, the gas discharged from the first discharge portion 33 forms a wall of air at the two sides of the sheet 11 in the widthwise direction. In this manner, the sheet conveyor 21 avoids a situation in which the sheet 11 moves sideways or meanders during transportation of the sheet 11.

(1-2) The sheet 11 includes the first sheet surface 12, the second sheet surface 13, the first layer 14, and the second layer 15. The second sheet surface 13 is opposite to the first sheet surface 12. The first layer 14 includes the first sheet surface 12 and the conductive layer 14A. The second layer 15 includes the second sheet surface 13 and is separable from the first layer 14. The sheet levitating unit 31 is arranged in the transport path 21A such that the first discharge portion 33 faces the first sheet surface 12.

With this structure, the sheet levitating unit 31 levitates the first sheet surface 12. This avoids a situation in which an object contacts the first layer 14 and scratches the conductive layer 14A.

(1-3) The sheet levitating unit 31 includes the gas storage portion 34 that forms the reservoir 35. The reservoir 35 temporarily stores the gas supplied from the gas supply unit 27. The first discharge portion 33 is part of the storage wall 34A that defines the gas storage portion 34. The first discharge portion 33 includes the through holes 36 that extend through the storage wall 34A. The through holes 36 are each formed by the first hole 36A and the second hole 36B. The first hole 36A extends from the inner surface 34B of the storage wall 34A. The second hole 36B extends from the first hole 36A to the outer surface 34C of the storage wall 34A. The second hole 36B is increased in diameter toward the outer surface 34C.

With this structure, the sheet levitating unit 31 levitates the sheet 11 using the first hole 36A and the second hole 36B in a preferred manner.

(1-4) The sheet levitating unit 31 includes the internal-pressure adjuster 37 that reduces the difference between the internal pressure proximate to the gas supply port 31A and the internal pressure distant from the gas supply port 31A in the gas storage portion 34.

With this structure, the sheet levitating unit 31 uses the internal-pressure adjuster 37 to reduce variations in the amount of air discharged from the through holes 36 of the first discharge portion 33.

(1-5) The internal-pressure adjuster 37 includes the adjustment plate 38. The adjustment plate 38 is configured to divide the reservoir 35 in the gas storage portion 34 into the first section 35A and the second section 35B. The first section 35A includes the first discharge portion 33. The second section 35B includes the gas supply port 31A and does not include the first discharge portion 33. The adjustment plate 38 includes the communication holes 38A that connect the first section 35A and the second section 35B.

With this structure, the sheet levitating unit 31 uses the adjustment plate 38 to reduce variations in the amount of air discharged from the through holes 36 of the first discharge portion 33.

(1-6) The first discharge portion 33 of the sheet levitating unit 31 includes the central region 33A and the peripheral region 33B located next to the central region 33A. The number of the through holes 36 in the central region 33A is greater than the number of the through holes 36 in the peripheral region 33B.

With this structure, the sheet levitating unit 31 levitates the sheet 11 in a preferred manner.

(1-7) The sheet conveyor 21 further includes the sheet separator 41 arranged between the first rotor 22 and the second rotor 23 in the transport path 21A of the sheet 11. The sheet separator 41 separates the sheet 11. The sheet separator 41 includes the suction portion 43 that faces the sheet 11 and suctions the sheet 11. The width W22 of the suction portion 43 is less than the width SW of the sheet 11.

With this structure, the width W22 of the suction portion 43 is less than the width SW of the sheet 11. Thus, the sheet separator 41 suctions the sheet 11 in a preferred manner.

(1-8) The sheet separator 41 includes the second discharge portion 44 that faces the sheet 11 and discharges gas toward the sheet 11.

With this structure, the sheet separator 41 levitates the sheet 11 with the second discharge portion 44 in a preferred manner.

(1-9) The stacking machine 1 includes the sheet conveyor 21 and the pressing device 2.

With this structure, the stacking machine 1 uses the sheet conveyor 21 to avoid a situation in which the sheet 11 moves sideways or meanders during transportation of the sheet 11. Thus, the stacking machine 1 stacks workpieces in a preferred manner.

Second Embodiment

Figure 10:
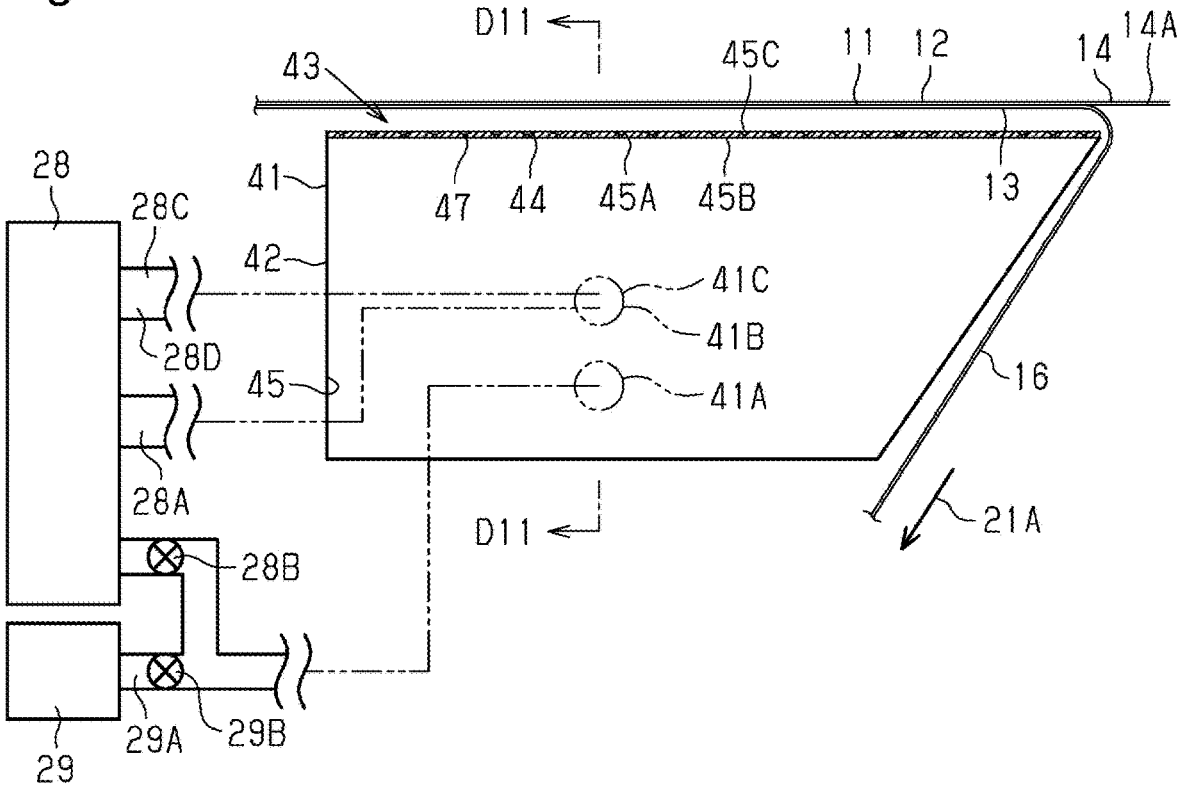
FIG. 10 is a schematic diagram showing a cross section of a sheet separator in accordance with a second embodiment.

A sheet conveyor 21 in accordance with a second embodiment will now be described with reference to FIGS. 8 to 10. In the second embodiment, the differences from the first embodiment will be described. The same reference names are given to those elements that are the same as the corresponding elements of the first embodiment. Such elements will not be described in detail.

Sheet Separator

The sheet separator 41 of the second embodiment further includes a first sheet-separator gas supply port 41B and a second sheet-separator gas supply port 41C through which gas is supplied. The sheet-separator gas supply unit 28 includes a fifth port 28C and a sixth port 28D. The fifth port 28C is connected to the first sheet-separator gas supply port 41B of the sheet separator 41. The sheet-separator gas supply unit 28 supplies gas through the fifth port 28C to the sheet separator 41. The sixth port 28D is connected to the second sheet-separator gas supply port 41C of the sheet separator 41. The sheet-separator gas supply unit 28 supplies gas through the sixth port 28D to the sheet separator 41.

The fifth port 28C may be arranged in a gas supply source that differs from the sheet-separator gas supply unit 28. When the fifth port 28C is arranged in a gas supply source that differs from the sheet-separator gas supply unit 28, the sheet separator 41 is supplied with gas from the gas supply source that differs from the sheet-separator gas supply unit 28 through the fifth port 28C. The sixth port 28D may be arranged in a gas supply source that differs from the sheet-separator gas supply unit 28. When the sixth port 28D is arranged in a gas supply source that differs from the sheet-separator gas supply unit 28, the sheet separator 41 is supplied with gas from the gas supply source that differs from the sheet-separator gas supply unit 28 through the sixth port 28D.

The suction portion 43 is arranged on part of the second discharge portion 44 of the sheet separator body 42. The other portions of the second discharge portion 44 are located at the outer side of the suction portion 43 in the width direction of the sheet separator body 42.

The sheet separator 41 further includes a partition wall 52 that divides the first gas storage portion 45 into a second gas storage portion 49, a third gas storage portion 50, and a fourth gas storage portion 51. The partition wall 52 includes a first partition wall 52A that divides the first gas storage portion 45 into the second gas storage portion 49 and the third gas storage portion 50. The partition wall 52 includes a second partition wall 52B that divides the first gas storage portion 45 into the third gas storage portion 50 and the fourth gas storage portion 51.

The first partition wall 52A divides the first reservoir 46 into a second reservoir 53 and a third reservoir 54. The second partition wall 52B divides the first reservoir 46 into the third reservoir 54 and a fourth reservoir 55. The second gas storage portion 49 defines the second reservoir 53. The third gas storage portion 50 defines the third reservoir 54. The fourth gas storage portion 51 defines the fourth reservoir 55. Part of the second discharge portion 44 that corresponds to the third gas storage portion 50 defines the suction portion 43. The gas in the third gas storage portion 50 is drawn out so as to suction the sheet 11. The second discharge portion 44 is used to levitate the sheet 11. Specifically, gas is supplied to the second gas storage portion 49, the third gas storage portion 50, and the fourth gas storage portion 51 in order to levitate the sheet 11.

The second gas storage portion 49 is supplied with gas through the fifth port 28C from the sheet-separator gas supply unit 28. The third gas storage portion 50 is supplied with gas through the third port 28A from the sheet-separator gas supply unit 28. The gas in the third gas storage portion 50 is drawn out through the fourth port 29A by the gas suction unit 29. The fourth gas storage portion 51 is supplied with gas through the sixth port 28D from the sheet-separator gas supply unit 28.

The sheet separator 41 includes a second internal-pressure adjuster 56. When the sheet-separator gas supply unit 28 supplies gas to the sheet separator 41, the second internal-pressure adjuster 56 reduces a difference between an internal pressure proximate to the first sheet-separator gas supply port 41B and an internal pressure distant from the first sheet-separator gas supply port 41B in the second gas storage portion 49. The second internal-pressure adjuster 56 has the same structure as the first internal-pressure adjuster 48. The second internal-pressure adjuster 56 is, for example, a plate that divides the second reservoir 53 into two sections.

The sheet separator 41 includes a third internal-pressure adjuster 57. When the sheet-separator gas supply unit 28 supplies gas to the sheet separator 41, the third internal-pressure adjuster 57 reduces a difference between an internal pressure proximate to the gas supply-suction port 41A and an internal pressure distant from the gas supply-suction port 41A in the third gas storage portion 50. The third internal-pressure adjuster 57 has the same structure as the first internal-pressure adjuster 48. The third internal-pressure adjuster 57 is, for example, a plate that divides the third reservoir 54 into two sections.

The sheet separator 41 includes a fourth internal-pressure adjuster 58. When the sheet-separator gas supply unit 28 supplies gas to the sheet separator 41, the fourth internal-pressure adjuster 58 reduces a difference between an internal pressure proximate to the second sheet-separator gas supply port 41C and an internal pressure distant from the second sheet-separator gas supply port 41C in the fourth gas storage portion 51. The fourth internal-pressure adjuster 58 has the same structure as the first internal-pressure adjuster 48. The fourth internal-pressure adjuster 58 is, for example, a plate that divides the fourth reservoir 55 into two sections.

Figure 12:
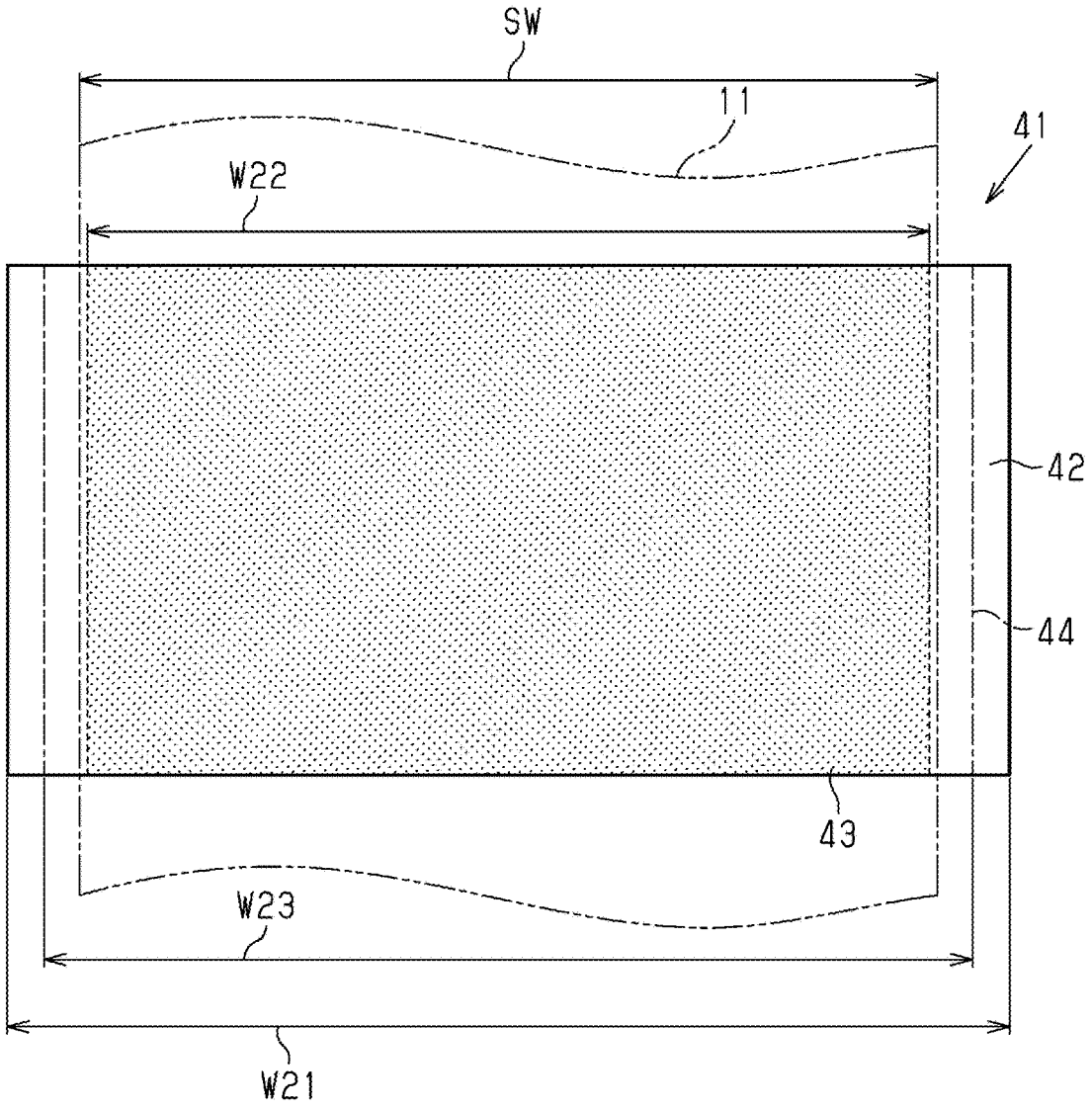
FIG. 12 is a schematic diagram showing a sheet, a separator, and a second discharge portion shown in FIG. 11.

As shown in FIG. 12, the width W21 of the sheet separator body 42 is greater than each of the width W22 of the suction portion 43 and the width W23 of the second discharge portion 44. The width W22 of the suction portion 43 is less than the width SW of the sheet 11. The width W23 of the second discharge portion 44 is greater than the width SW of the sheet 11.

Advantages of the Second Embodiment

The second embodiment has the following advantages.

Figure 11:
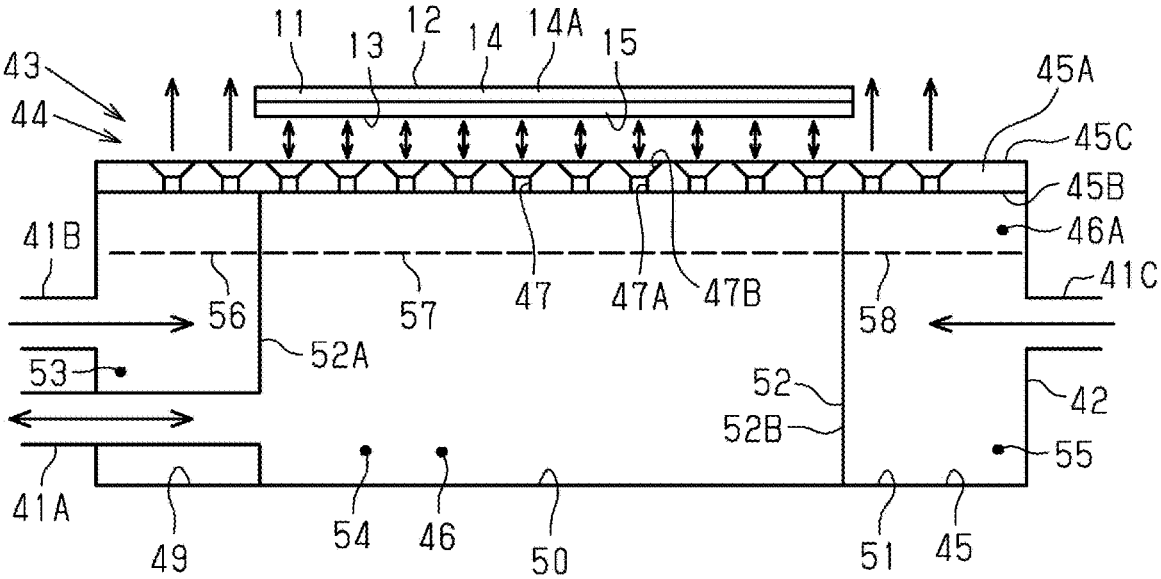
FIG. 11 is a schematic diagram of the sheet separator showing a cross section taken along line D11-D11 in FIG. 10.

(2-1) FIG. 11 schematically shows the gas being discharged from the second discharge portion 44. Since the width W23 of the second discharge portion 44 is greater than the width SW of the sheet 11, the gas discharged from the first discharge portion 33 forms a gas wall at the two opposite sides of the sheet 11. This restricts sideward movement and meandering of the sheet 11.

Third Embodiment

Figure 13:
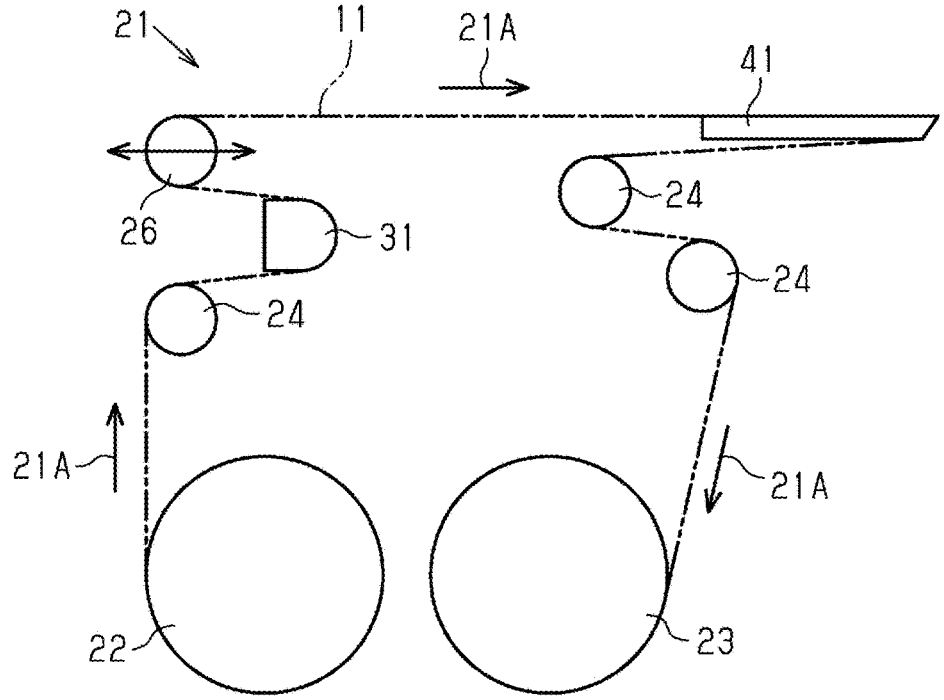
FIG. 13 is a schematic diagram showing a sheet conveyor in accordance with a third embodiment.

A sheet conveyor 21 in accordance with a third embodiment will now be described with reference to FIG. 13. In the third embodiment, the differences from the first embodiment will be described. The same reference names are given to those elements that are the same as the corresponding elements of the first embodiment. Such elements will not be described in detail.

The sheet conveyor 21 of the third embodiment includes the first rotor 22, the second rotor 23, the guide rolls 24, the tension roll 26, the sheet levitating unit 31, and the sheet separator 41. The guide rolls 24 include, for example, three guide rolls 24. In the third embodiment, the tension roll 26 includes a support shaft configured to be moved sideward so as to adjust the tension applied to the sheet 11.

The transport path 21A of the third embodiment will now be described. When the first rotor 22 feeds the sheet 11, the sheet 11 is guided by the first guide roll 24 and conveyed to the sheet levitating unit 31. The sheet 11 conveyed to the sheet levitating unit 31 is then conveyed to the tension roll 26. After the sheet 11 is conveyed to the tension roll 26, the sheet 11 is guided by the guide roll 24 and conveyed to the sheet separator 41. At the sheet separator 41, workpieces are cut out of the first layer 14 of the sheet 11. Then, the pressing device 2 stacks the workpieces sent to the pressing device 2. The sheet remaining portion 16, which is separated from the first layer 14 of the sheet 11, is guided by the two guide rolls 24 and rolled up by the second rotor 23.

Advantage of the Third Embodiment

The third embodiment has the following advantages.

(3-1) The sheet conveyor 21 of the third embodiment includes the first rotor 22, the second rotor 23, the guide rolls 24, the tension rolls 26, the sheet levitating unit 31, and the sheet separator 41. This allows the sheet conveyor 21 to convey the sheet 11 with a minimal configuration, thereby reducing the number of components.

Fourth Embodiment

A sheet conveyor 21 and a printing machine 3 in accordance with a fourth embodiment will now be described with reference to FIG. 14. In the third embodiment, the differences from the first embodiment will be described. The same reference names are given to those elements that are the same as the corresponding elements of the first embodiment. Such elements will not be described in detail.

Figure 14:
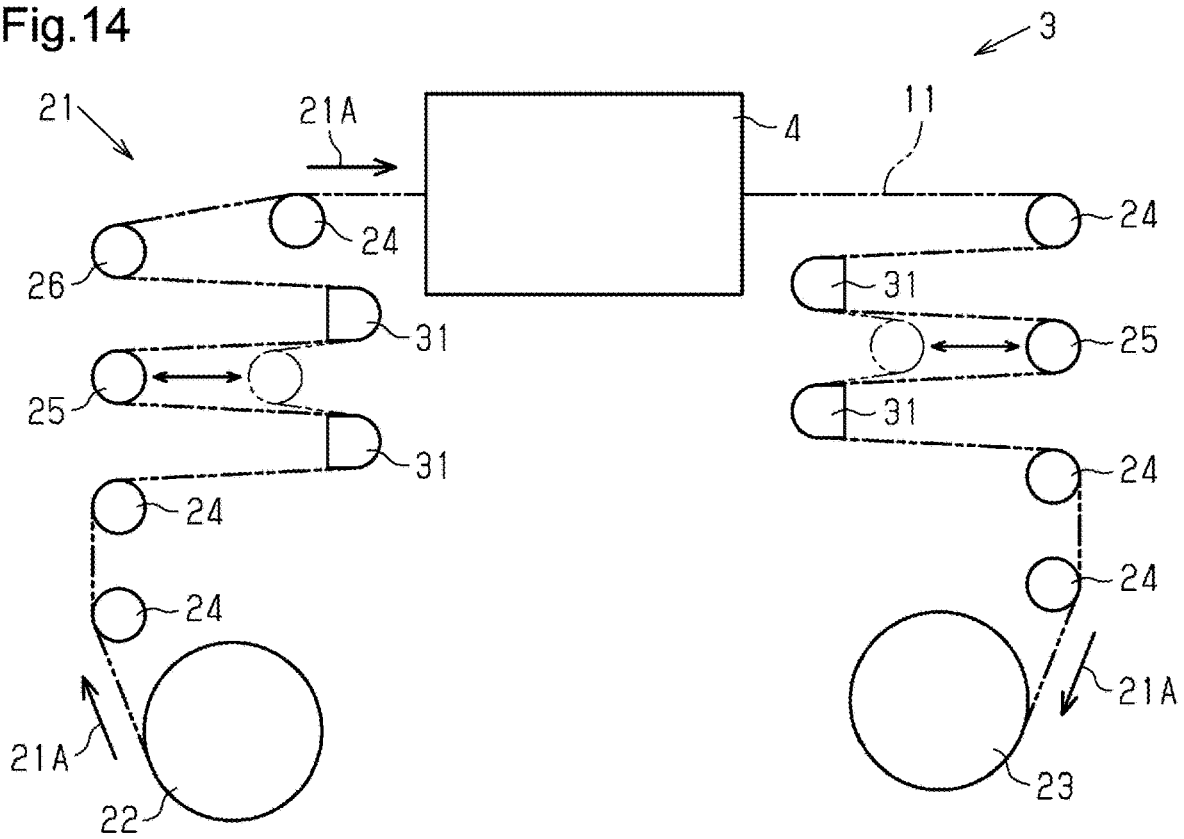
FIG. 14 is a schematic diagram of a printing machine including a sheet conveyor and a printing device in accordance with a fourth embodiment.

As shown in FIG. 14, the printing machine 3 includes the sheet conveyor 21 and a printing device 4. The printing device 4 is configured to print an internal electrode on the sheet 11. The printing device 4 is, for example, configured to perform silk screen printing or inkjet printing. The sheet conveyor 21 of the fourth embodiment has the same configuration as the sheet conveyor 21 of the first embodiment except in that the sheet conveyor 21 does not include the sheet separator 41.

The transport path 21A of the fourth embodiment will now be described. When the first rotor 22 feeds the sheet 11, the sheet 11 is guided by the two guide rolls 24 and conveyed to the sheet levitating units 31. The first dancer roll 25 is arranged between the two sheet levitating units 31. The sheet 11 is conveyed from the first sheet levitating unit 31 to the first dancer roll 25 and then to the second sheet levitating unit 31. The sheet 11 is conveyed from the second sheet levitating unit 31 to the tension roll 26. After the sheet 11 is conveyed to the tension roll 26, the sheet 11 is guided by the guide roll 24 and conveyed to the printing device 4.

The sheet 11 that underwent printing by the printing device 4 is guided by the guide roll 24 and conveyed to the sheet levitating units 31. The second dancer roll 25 is arranged between the two sheet levitating units 31. The sheet 11 is conveyed from the first sheet levitating unit 31 to the first dancer roll 25 and then to the second sheet levitating unit 31. The sheet 11 is conveyed from the second sheet levitating unit 31 to the two guide rolls 24. The sheet 11 is guided by the two guide rolls 24 and then rolled up by the second rotor 23.

Advantages of the Fourth Embodiment

The fourth embodiment has the following advantages.

(4-1) The printing machine 3 includes the sheet conveyor 21 and the printing device 4.

With this structure, the printing machine 3 uses the sheet conveyor 21 to avoid a situation in which the sheet 11 moves sideways or meanders during transportation of the sheet 11. Thus, the printing machine 3 performs printing on the sheet 11 in a preferred manner.

Modified Examples

In addition to the embodiments described above, the sheet conveyor, the stacking machine, and the printing machine according to the present disclosure are applicable to modified examples that are described below and combinations of at least two of the modified examples that do not contradict each other.

In the sheet levitating unit 31 of the second embodiment, as long as the sheet levitating unit 31 has a configuration for levitating the sheet 11, the width W12 of the first discharge portion 33 does not have to be greater than the width SW of the sheet 11.

The sheet separator 41 of the third embodiment may have the same configuration as the sheet separator 41 of the second embodiment.

The description related with the above embodiments exemplifies, without any intention to limit, applicable forms of the sheet conveyor, the stacking machine, and the printing machine according to the present disclosure. The sheet conveyor, the stacking machine, and the printing machine according to the present disclosure may be modified from the embodiments described above.

Ordinal numerals such as "first", "second", and "third" as used in this specification are only to distinguish members having the same name from one another and are not intended to have any special meaning.

REFERENCE SIGNS LIST

1) stacking machine, 2) pressing device, 3) printing machine, 4) printing device, 11) sheet, 12) first sheet surface, 13) second sheet surface, 14) first layer, 14A) conductive layer, 15) second layer, 21) sheet conveyor, 21A) transport path, 22) first rotor, 23) second rotor, 27) gas supply unit, 31) sheet levitating unit, 31A) gas supply port, 33) first discharge portion, 33A) central region, 33B) peripheral region, 34) gas storage portion, 34A) storage wall, 34B) inner surface, 34C) outer surface, 35) reservoir 35A) first section, 35B) second section, 36) through hole, 36A) first hole, 36B) second hole, 37) inner-pressure adjuster, 38) adjustment plate, 38A) connection hole, 41) sheet separator 43) suction portion, 44B) second discharge portion.

The invention claimed is:

1. A sheet conveyor that conveys a sheet, the sheet conveyor comprising:
- a first rotor that feeds the sheet;
- a second rotor that rolls up the sheet; and
- a sheet levitating unit arranged between the first rotor and the second rotor in a transport path of the sheet and levitates the sheet, wherein
- the sheet levitating unit includes a first discharge portion that faces the sheet and discharges gas toward the sheet, and
- the first discharge portion is wider than the sheet,
- the sheet levitating unit includes a gas storage portion that forms a reservoir, the reservoir temporarily storing gas supplied from a gas supplying unit;
- the first discharge portion is part of a storage wall that defines the gas storage portion;
- the first discharge portion includes through holes extending through the storage wall; and
- the through holes are each formed by a first hole and a second hole, the first hole extending from an inner surface of the storage wall, the second hole extending from the first hole to an outer surface of the storage wall and increased in diameter toward the outer surface.

2. The sheet conveyor according to claim 1, wherein:
- the sheet includes a first sheet surface, a second sheet surface opposite to the first sheet surface, a first layer including the first sheet surface and a conductive layer, and a second layer including the second sheet surface and separable from the first layer; and
- the sheet levitating unit is arranged in the transport path such that the first discharge portion faces the first sheet surface.

3. The sheet conveyor according to claim 1, wherein the sheet levitating unit includes an internal-pressure adjuster that reduces a difference between an internal pressure proximate to a gas supply port and an internal pressure distant from the gas supply port in the gas storage portion.

4. The sheet conveyor according to claim 3, wherein
- the internal-pressure adjuster includes an adjustment plate,
- the adjustment plate is configured to divide the reservoir in the gas storage portion into a first section and a second section,
- the first section includes the first discharge portion,
- the second section includes the gas supply port and does not include the first discharge portion, and
- the adjustment plate includes connection holes that connect the first section and the second section.

5. The sheet conveyor according to claim 1, wherein
- the first discharge portion of the sheet levitating unit includes a central region and a peripheral region located next to the central region, and
- the central region includes a greater number of the through holes than the peripheral region.

6. A stacking machine, comprising:
- the sheet conveyor according to claim 1; and
- a pressing device.

7. A printing machine, comprising:
- the sheet conveyor according to claim 1; and
- a printing device.

8. A sheet conveyor that conveys a sheet, the sheet conveyor comprising:
- a first rotor that feeds the sheet;
- a second rotor that rolls up the sheet; and
- a sheet levitating unit arranged between the first rotor and the second rotor in a transport path of the sheet and levitates the sheet, wherein
- a sheet separator arranged between the first rotor and the second rotor in the transport path of the sheet and separates the sheet, wherein
- the sheet levitating unit includes a first discharge portion that faces the sheet and discharges gas toward the sheet, and
- the first discharge portion is wider than the sheet
- the sheet separator includes a suction portion that faces the sheet and suctions the sheet, and
- the suction portion is narrower than the sheet.

9. The sheet conveyor according to claim 8, wherein the sheet separator includes a second discharge portion that faces the sheet and discharges gas toward the sheet.

10. A stacking machine, comprising:
- the sheet conveyor according to claim 8; and
- a pressing device.

11. A printing machine, comprising:
- the sheet conveyor according to claim 7; and
- a printing device.

* * * * *